US005117262A

United States Patent [19]

Yamaguchi

[11] Patent Number: 5,117,262

[45] Date of Patent: May 26, 1992

[54] ELECTROPHOTOGRAPHIC APPARATUS WITH DETACHABLE OZONE FILTER MOUNTED NEAR CHARGING DEVICE

[75] Inventor: Yasuyoshi Yamaguchi, Tagata, Japan

[73] Assignee: Tokyo Electric Co., Ltd., Tokyo, Japan

[21] Appl. No.: 648,227

[22] Filed: Jan. 31, 1991

[30] Foreign Application Priority Data

Jan. 31, 1990 [JP] Japan ..... 2-20903

[51] Int. Cl.[5] ..... G03G 15/00

[52] U.S. Cl. ..... 355/215; 355/219

[58] Field of Search ..... 355/210, 215, 200, 296, 355/219, 221

[56] References Cited

U.S. PATENT DOCUMENTS 3,814,515 6/1974 Takahashi et al. ..... 355/215
4,442,190 4/1984 Kitajima et al. ..... 355/219 X
4,540,268 9/1985 Toyono et al. ..... 355/210

FOREIGN PATENT DOCUMENTS 58-190967 11/1983 Japan ..... 355/215
62-153965 7/1987 Japan ..... 355/215
63-49228 10/1988 Japan .
63-168447 11/1988 Japan .
63-168448 11/1988 Japan .
64-59365 3/1989 Japan .
1-94955 6/1989 Japan .
1-155059 10/1989 Japan .

*Primary Examiner*—Joan H. Pendegrass
*Assistant Examiner*—Shuk Y. Lee
*Attorney, Agent, or Firm*—Oblon, Spivak, McClelland, Maier & Neustadt

[57] ABSTRACT

The electrophotographic apparatus comprises a charging device disposed to confront a photosensitive member and a unit member fitted detachably inside the apparatus, with an ozone filter being mounted detachably in close proximity to the charging device inside the unit member. Ozone created by the charging device is dissolved promptly by the ozone filter by being led by a turning air stream produced by the rotation of the photosensitive member. The ozone filter can easily be replaced by taking the unit member out of the apparatus.

10 Claims, 3 Drawing Sheets

ELECTROPHOTOGRAPHIC APPARATUS WITH DETACHABLE OZONE FILTER MOUNTED NEAR CHARGING DEVICE

FIELD OF THE INVENTION AND RELATED ART STATEMENT

The present invention relates to an electrophotographic apparatus which operates to transfer an electrostatic latent image formed on a photosensitive member onto a sheet of paper thereby to print the image on it, and particularly to an electrophotographic apparatus in which the charging device for charging the photosensitive member creates so much ozone as to be harmful to the human body.

The electrophotographic apparatus has its charging device operating to charge the photosensitive member prior to the formation of an electrostatic latent image on the photosensitive member and also to charge a print paper so as to transfer the activated toner image on the photosensitive member onto the paper. In this case, if discharging takes place with a negative polarity, the device produces so much ozone as to be harmful to the photosensitive member and human body. On this account, it is a general convention to place an ozone filter in the vicinity to the cooling fan so that ozone is dissolved by the filter, as described in Japanese Patent Unexamined Publication No. 64-59365. However, this conventional technique involves the following problems.

Firstly, in the arrangement with the ozone filter disposed in the vicinity to the ventilation fan, hot air around the fixing device and photosensitive member needs to be evacuated through the ozone filter, and a large-capacity ventilation fan is required. The used of a large-capacity ventilation fan unfavorably increases the dimensions of the apparatus, the fan noise of the apparatus, and the cost of the component parts.

Secondary, the disposition of the ozone filter in the vicinity to the ventilation fan rends itself away from the ozone-sourcing charging device, causing the ozone stream to circulate in the apparatus before it reaches the ozone filter. The circulation of the ozone stream inside the apparatus is unfavorable because of the exposure of the photosensitive member to ozone and the possible leakage of ozone to the outside.

A further disadvantage of this conventional apparatus is the awkward treatment for the replacement of the ozone filter.

OBJECT AND SUMMARY OF THE INVENTION

The first object of the present invention is to provide an electrophotographic apparatus in which ozone created by the charging device can surely be dissolved before it comes in contact with the photosensitive member or leaks out to the exterior of the apparatus.

The second object of the present invention is provide an electrophotographic apparatus which does not need to have a larger cooling ventilation fan due to the provision of the ozone filter.

The third object of the present invention is to provide an electrophotographic apparatus which allows easy replacement of the ozone filter.

In order to achieve the above objectives, the present invention resides in an electrophotographic apparatus which operates to form an electrostatic latent image on a photosensitive member through the selective application of light signals produced by an exposure device to the photosensitive member which has been charged by a charging device, develop the electrostatic latent image with a development device, and transfer the image on to a sheet of paper with a transfer device thereby to print the image on the paper, wherein the apparatus is provided therein detachably with a unit member in which the charging device is fitted and an ozone filter is mounted detachably in the vicinity to the charging device. In consequence, ozone created by the charging device is carried promptly to the ozone filter by the turning air stream produced by the rotation of the photosensitive member and it is dissolved promptly, instead of drifting to other sections. Hence, such unfavorable events as the exposure of the photosensitive member to ozone and the leakage of ozone to the exterior of the apparatus are prevented. Hot air to be ventilated to the outside of the apparatus does not pass through the ozone filter, and hence a small ventilation fan suffices for the evacuation of the interior hot air. In addition, by taking the unit member out of the apparatus, the ozone filter which is mounted in it can easily be replaced.

DESCRIPTION OF THE PREFERRED EMBODIMENT

Figure 1:
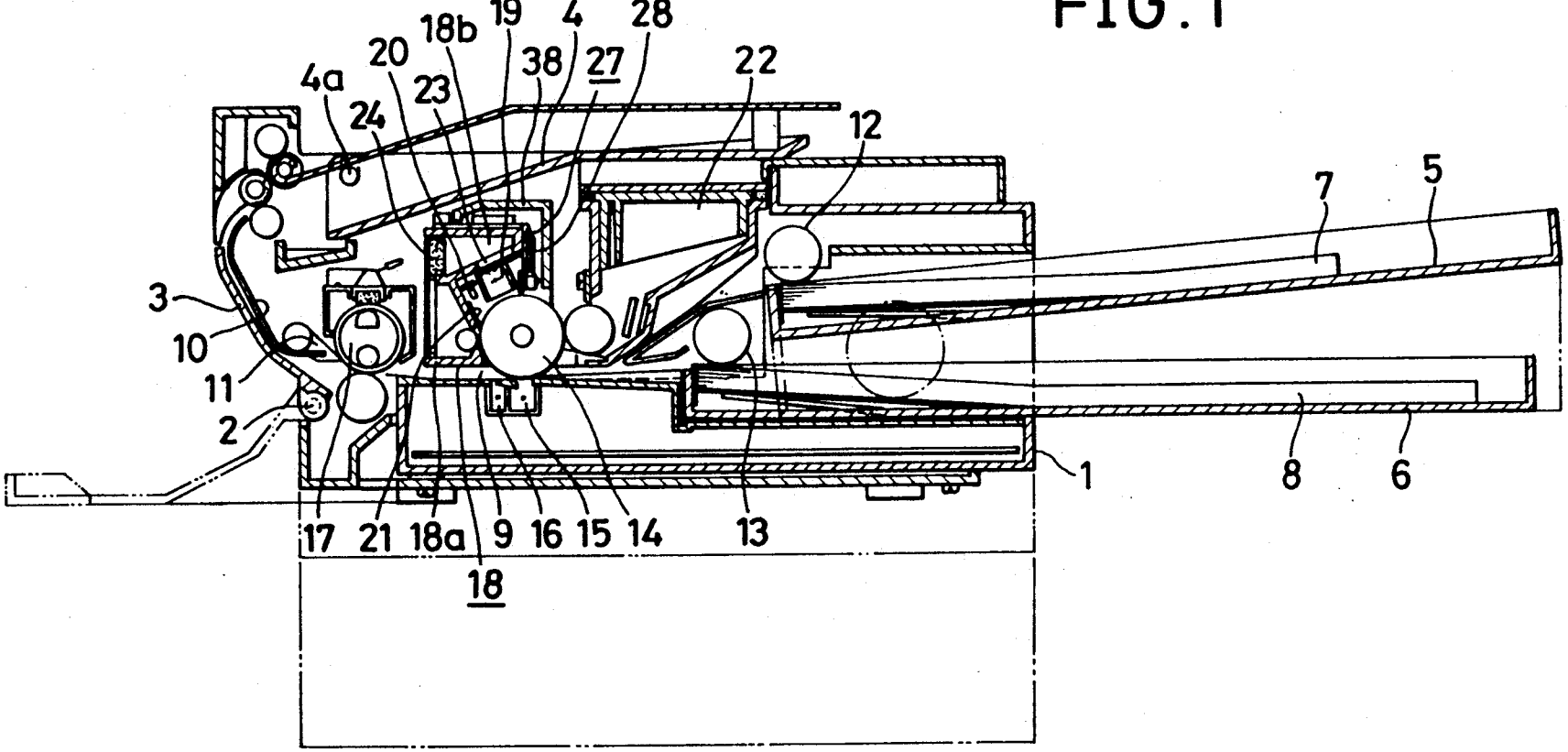
FIG. 1 is a vertical cross-sectional diagram showing an embodiment of the present invention.

An embodiment of the present invention will be described with reference to the drawings. FIG. 1 is a vertical cross-sectional diagram showing the overall structure of the apparatus, in which indicated by 1 is the main unit of the electrophotographic apparatus. At the rear end of the main unit 1, a paper guide plate 3 is fitted rotatably on a pivot 2, and a paper tray 4 is mounted rotatably and detachably on a pivot 4*a* at the top of the main unit 1. The main unit 1 is provided with a paper transportation path 9 for feeding a sheet of paper 7 or 8 in a paper supply cassette 5 or 6, and in the rear of the paper transportation path 9, there is provided a guide plate 10 which confronts the paper guide plate 3 and guides the paper 7 or 8 toward the paper tray 4. Provided in the paper transportation path 9 are paper feed rollers 12 and 13 which are in contact with the uppermost ones of papers 7 and 8 in the paper supply cassettes 5 and 6, a transfer device 15 which applies charges to the paper 7 or 8 for transferring a developed image on the photosensitive member 14, a discharging device 16 which removes residual charges on the paper 7 or 8, a fixing device 17 which fixes the transferred image on the paper 7 or 8 that has passed through the transfer device 15, and a separator 11 which is in contact with the fixing roller in the fixing device 17 and function to separate the paper from the fixing roller, all disposed in order from the upperstream to downstream portions of the path.

The main unit 1 further incorporates a supporting member 18*a* and a development device 22, both fitted detachably, and a unit member 18 which incorporates a charging device 19 for applying charges to the photosensitive member 14 prior to the formation of a electrostatic latent image, a discharging device 20 which implements the light exposure for the photosensitive member 14 and unifies charges on the exterior surface of the photosensitive member 14, a cleaning device 21, and an ozone filter 24, all fitted on the supporting member 18*a*. The supporting member 18*a* has a formation of an opening 23 at the position of the charging device 19 opposite to the photosensitive member 14, with a room 18*b* being formed between the opening 23 and the intake surface 24*a* of the ozone filter 24. The photosensitive member 14 is supported rotatably by the supporting member 18*a* of the unit member 18.

Figure 3:
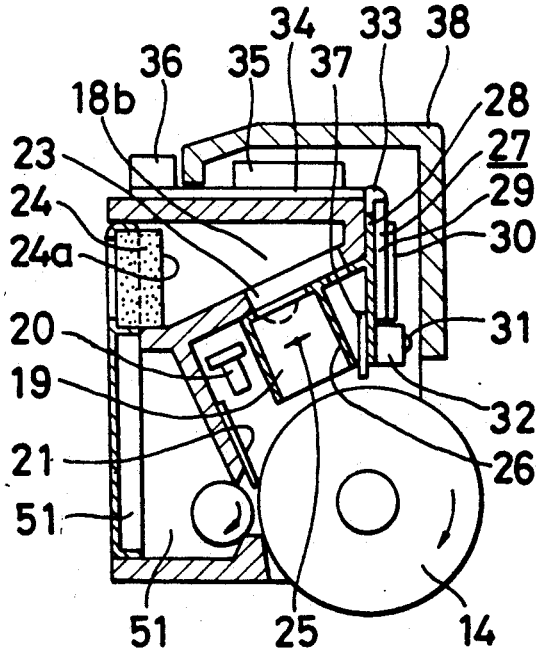
FIG. 3 is a vertical cross-sectional diagram of the structure shown in FIG. 2.

As shown in FIG. 3, the charging device 19 has a frame 26 with a cross-sectional shape of channel for stretching a charging wire 25. The frame 26 is formed by drawing an aluminum bar, and it has a bracket section 28 for supporting the exposure device 27 of the self-scanning type. The exposure device 27 is made up of a circuit board 29 fixed to the bracket 28, an end-plane light-emitting board 30 fixed to the circuit board 29, and a focus lens 32 which is fixed to the bracket 28 by means of a hinge 31. The end-plane light-emitting board 30 has a linear arrangement of many EL elements, although they are not shown in the figure. On the upper surface of the supporting member 18*a*, there is fixed a circuit board 34 which is connected to the circuit board 29 by a cable 33, and circuit component parts for driving the exposure device 27 and a connector 36 for connection with the external circuit are mounted on the circuit board 34. Further fixed on the bracket 28 is an insulation board 37 which provides blocking and insulation between the charging device 19 and the exposure device 27 in the vicinity to the photosensitive member 14. Indicated by 38 is a cover which is supported by the supporting member 18*a* and is used to cover the exposure device 27.

Figure 2:
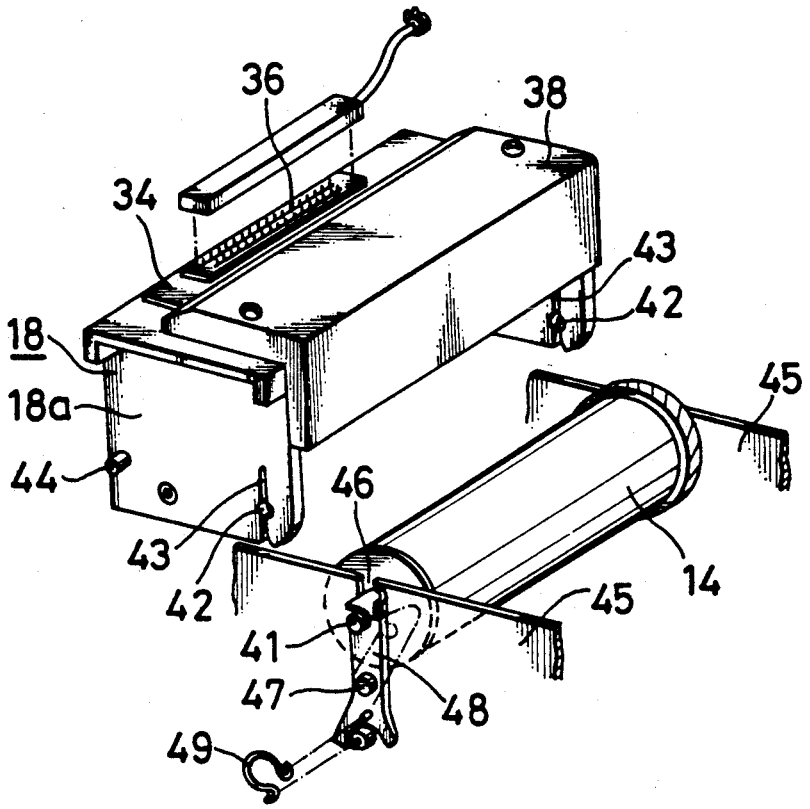
FIG. 2 is a perspective diagram showing by expansion the supporting structure for the photosensitive member and light exposure device.

As shown in FIG. 2, the supporting member 18*a* has on its both sides formations of shaft holes 42 in which both ends of a shaft 41 for supporting the photosensitive member 14 rotatably are stopped, slits 43 running through the center of the shaft holes 42, and bosses 44 extending externally. Based on this structure, the photosensitive member 14 is fitted to the supporting member 18*a* by placing both ends of the shaft 41 in the shaft holes 42 while expanding the slits 43 resiliently. The unit member 18 is fitted to a frame 45 by inserting the shaft 41 of the photosensitive member 14 into a U-shaped groove 46 of the upper opening formed in the frame 45 which is provided inside the main unit 1 until the bosses 44 are in contact with the upper edge of the frame 45. A hook 48 for pushing the shaft 41 to the bottom of the groove 46 is attached rotatably on a pivot 47 on the frame 45. The hook 48 is applied with a force by a toggle spring 49 to both sides of its neutral position.

Figure 4:
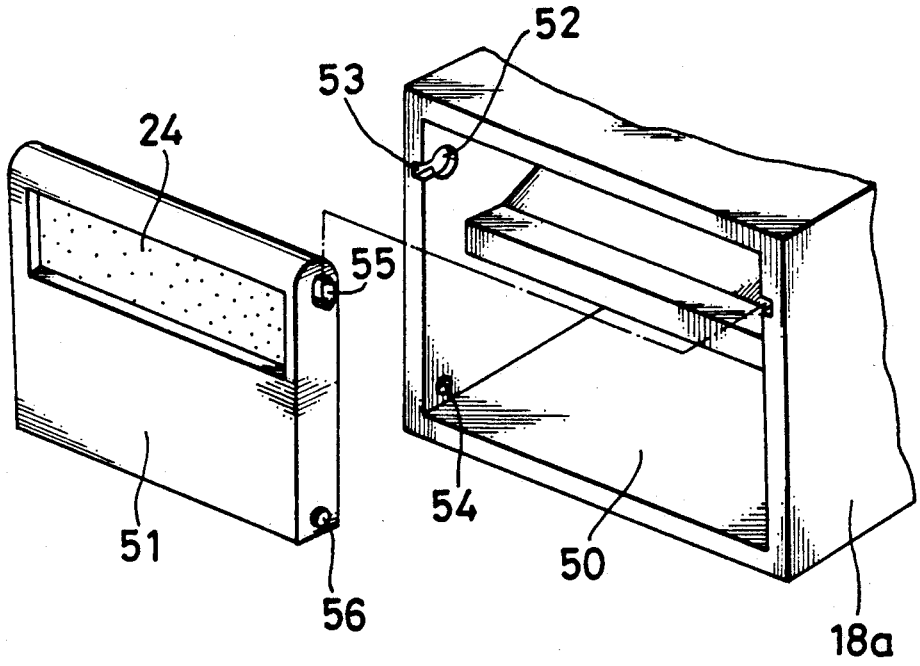
FIG. 4 is a perspective diagram showing by expansion the supporting structure of the ozone filter.

As shown in FIG. 4, the ozone filter 24 is held in a lid 51 which closes a toner chamber 50 which is formed in the supporting member 18*a*. The toner chamber 50 is to collect residual toner which is removed from the photosensitive member 14 by the cleaning device 21. Formed in each of the interior walls at the edge of opening of the toner chamber 50 are a circular recess 52, a groove 53 which extends from the recess toward the edge, and a stop hole 54 near the bottom of the wall. The lid 51 has on each lateral end thereof formations of an elongated round boss 55 dimensioned to have a major span slightly smaller than the recess 52 and a minor span slightly smaller than the groove 53, and a boss 56 located near the bottom. Based on this structure, the lid 51 is fitted to the supporting member 18*a* by inserting the boss 55 through the groove 53 into the recess 52 while holding the lid 51 in a virtually horizontal attitude, then turning the lid 51 downward around the common center of the recess 52 and boss 55 until the boss 56 engages resiliently with the stop hole 54.

Based on the foregoing structure of the apparatus, the photosensitive member 14 is charged at a certain interval during the rotation by the charging device 19, the charged portion is scanned by the light beam from the exposure device 27, resulting in the formation of an electrostatic latent image, and the image is developed by the development device 22. A sheet of paper 7 or 8 in the paper supply cassette 5 or 6 is drawn by the feed roller 12 or 13 to the positon between the photosensitive member 14 and transfer device 15, where the developed image on the photosensitive member 14 is transferred to the paper 7 or 8 by the transfer device 15, and, after the image is fixed by the fixing device 17, the paper 7 or 8 is delivered to the paper tray 4. As shown by the dash-dot line in FIG. 1, when the paper guide plate 3 is swung downward, it functions as the paper tray.

The photosensitive member 14 is cleaned by the cleaning device 21, but it may not be cleared of toner completely some times. Although toner is attracted by charges on the photosensitive member 14, a small part of toner may stray from it at portions discharged through the exposure to the light from the exposure device 27. The stray toner will move by being airborne in the turning air stream created by the rotation of the photosensitive member 14, but it does not reach the focus lens 32 by being blocked by the insulation board 37. The insulation board 37 also retards the influence of corona discharge at the charging device 19 on the exposure device 27.

The turing air stream created by the rotation of the photosensitive member 14 is led together with hot air to the insulation board 37 and they are ventilated effectively through the opening 23. The ozone filter 24 is located in this evacuation path, and hence ozone created by the discharging of the charging device 19 can be dissolved effectively by the ozone filter 24. Moreover, the room 18*b* in front of the ozone filter 24 provides a good route of air stream, and it is also possible to accumulate the ozone stream in this room and conduct it through the ozone filter slowly. Consequently, the ozone stream near the ozone-sourcing charging device 19 can be dissolved promptly, whereby such unfavorable events as the exposure of the photosensitive member 14 to ozone and the leakage of ozone can surely be prevented. As a result, even in the provision of a fan for drawing the air stream containing ozone toward the ozone filter 24, the fan can be driven with a small motor, and the noise level of the apparatus can be lowered. The opening 23 for conducting ozone to the ozone filter 24 is formed in the portion of the charging device 19 opposite to the photosensitive member 14. This arrangement allows the disposition of other members in close proximity to the charging device 19 at the circumferential position of the photosensitive member 14 contiguous to the charging device 19, whereby the interior space of the apparatus can be used efficiently. In addition, by taking the unit member 18 out of the frame 45 of the main unit 1 and separating the lid 51 from the supporting member 18*a*, the ozone filter 24 can easily be replaced. At this time, toner collected inside the supporting member 18*a* is removed from the toner chamber 50, and both treatments of toner removal and ozone filter replacement are simplified owing to the detatchable arrangement of the lid 51.

In the foregoing embodiment, corona discharge by the charging device 19 takes place with a negative polarity, and hence toner charged to the negative polarity is attracted to the portions of the photosensitive member 14 which have been discharged through the exposure to the light from the exposure device 27. Corona discharge in the transfer device 15 takes place with a positive polarity. Corona discharge with a positive polarity creates little ozone, and therefore no ozone filter is required in the neighborhood of the transfer device 15.

What is claimed is:

1. An electrophotographic apparatus comprising:

a photosensitive member provided rotatably inside the apparatus and having an exterior surface;

a charging device which is disposed to confront the exterior surface of said photosensitive member and adapted to charge said photosensitive member;

an exposure device which projects a light signal carrying image information onto the exterior surface of said photosensitive member that has been charged by said charging device;

a development device which is disposed to confront the exterior surface of said photosensitive member and adapted to develop an electrostatic latent image formed on said photosensitive member;

a transportation path for feeding paper through said apparatus;

a transfer device which transfers the electrostatic latent image on said photosensitive member developed by said development device onto said paper;

a fixing device which is disposed downstream of said photosensitive member in said transportation path;

a unit member in which said charging device is fixed and an ozone filter is mounted detachably near said charging device, said unit member being supported detachably inside said apparatus; wherein a toner chamber which accommodates toner removed from said photosensitive member and a lid which closes said toner chamber are formed on said unit member, said ozone filter being attached to said lid to form a unitary member.

2. An electrophotographic apparatus according to claim 1, wherein said unit member is provided with a space at a position between said charging device and an intake surface of said ozone filter.

3. An electrophotographic apparatus according to claim 1, wherein an opening is provided between a portion of said charging device opposite to said photosensitive member and an intake surface of said ozone filter, thereby providing an ozone evacuation path fluidically connecting said charging device with said ozone filter.

4. An electrophotographic apparatus according to claim 1, wherein a blocking member, with one side thereof being in close proximity to said photosensitive member, is attached to said unit member at a position between said charging device and said exposure device.

5. An electrophotographic apparatus according to claim 1, wherein an insulation member is attached to said unit member at the position between said charging device and said exposure device.

6. An electrophotographic apparatus according to claim 1, wherein said lid is openable and reclosable.

7. An electrophotographic apparatus according to claim 1, wherein said unit member includes means for pivotally mounting said lid.

8. An electrophotographic apparatus according to claim 7, wherein said unit member includes a supporting member rotatably supporting said photosensitive member, and wherein said means for pivotally mounting said lid is provided on said supporting member.

9. An electrophotographic apparatus according to claim 8, wherein one of said lid and said supporting member includes bosses and the other of said lid and said supporting member includes recesses for rotatably receiving said bosses.

10. An electrophotographic apparatus according to claim 9, wherein one of said bosses is an oblong boss having a major span and a minor span and wherein one of said recesses is a recess for receiving said oblong boss, said recess for receiving said oblong boss having a diameter larger than said major span and being connected to a groove, said groove having a width dimension smaller than said major span and larger than said minor span of said oblong boss.

* * * * *